US005083932A

United States Patent [19]

Wyatt et al.

[11] Patent Number: 5,083,932

[45] Date of Patent: Jan. 28, 1992

[54] IGNITER CABLE CONNECTOR SEAL

[75] Inventors: Everett M. Wyatt, Central Valley; LeRoy B. Adam, Redding, both of Calif.

[73] Assignee: Cooper Industries, Inc., Houston, Tex.

[21] Appl. No.: 728,860

[22] Filed: Jul. 11, 1991

Related U.S. Application Data

[63] Continuation of Ser. No. 480,439, Feb. 15, 1990, abandoned.

[51] Int. Cl.[5] ..... H01R 13/52

[52] U.S. Cl. ..... 439/126

[58] Field of Search ..... 439/125, 126, 127, 128

[56] References Cited

U.S. PATENT DOCUMENTS

| | | | |
|---|---|---|---|
| 2,129,961 | 9/1938 | Rabezzana | 123/169 |
| 2,238,397 | 4/1941 | Rabezzana | 123/169 |
| 2,351,066 | 6/1944 | Race | 315/326 |
| 2,365,219 | 12/1944 | Rose | 439/125 |
| 2,399,390 | 4/1946 | Robertson | 174/35 |
| 2,459,286 | 1/1949 | Rabezzana et al. | 439/125 |
| 2,651,298 | 9/1953 | Brinson et al. | 439/126 |
| 2,913,696 | 11/1959 | Burgher | 439/126 |
| 3,050,658 | 8/1962 | Lay et al. | 439/125 |
| 3,076,113 | 1/1963 | Candelise | 315/135 |
| 3,334,326 | 8/1967 | Besore et al. | 439/127 |
| 4,145,106 | 3/1979 | Livingston | 439/126 |
| 4,266,841 | 5/1981 | Sherwood | 439/312 |
| 4,978,309 | 12/1990 | Straub | 439/126 |

FOREIGN PATENT DOCUMENTS

| | | | |
|---|---|---|---|
| 209818 | 3/1956 | Australia | 439/126 |
| 684804 | 12/1952 | United Kingdom | 439/125 |

*Primary Examiner*—Gary F. Paumen

*Attorney, Agent, or Firm*—MacMillan, Sobanski & Todd

[57] ABSTRACT

An improved seal for a high voltage igniter cable connector for aircraft applications. An insulator projecting from the cable connector extends into a tubular insulator in the igniter. An electrical contact at the free end of the connector insulator is urged into contact with a terminal in the igniter. A resilient annular seal is located between an annular shoulder or step on the connector insulator, the interior and end surfaces on the igniter insulator, the igniter shell and a spring cap or retainer. The spring retainer is shaped to force the resilient seal both against the connector insulator shoulder or step and against the end of the igniter insulator. Above the insulator shoulder or step, the compressed seal expands to form a radial seal between the igniter and connector insulators. Above the igniter insulator end, the compressed seal expands to form a seal between the igniter insulator end and the connector insulator and, preferably, also to the igniter shell.

12 Claims, 3 Drawing Sheets

IGNITER CABLE CONNECTOR SEAL

This is a continuation of application Ser. No. 07/480,439 filed Feb. 15, 1990, now abandoned.

TECHNICAL FIELD

This invention relates to high voltage electrical connectors for engine ignition systems and more particularly to an improved seal for a high voltage connector for connecting a shielded ignition cable to an igniter used in aircraft engine applications.

BACKGROUND ART

Connectors for high voltage cables used in aircraft ignition systems are subject to extreme operating conditions. The reduced atmospheric pressure in which the connectors are used increases the tendency for flashover or short-circuiting to occur at the interface between the igniter and the connector.

In one type of igniter commonly used for aviation engines, a center electrode terminal is recessed within the bore of a tubular ceramic insulator. An outer metallic igniter shell or a tubular metal sleeve attached to the shell surrounds and shields the outside of the tubular insulator. The free end of the sleeve adjacent to an open end of the insulator has an external thread for retaining a coupling nut on a cable connector. When the cable connector is secured to the igniter, an insulator on the connector projects into the tubular igniter insulator bore and a high voltage contact mounted at the end of the connector insulator is urged by springs inside the connector against the center electrode terminal. The cable connector functions both to electrically connect the high voltage cable to the igniter and to prevent flashover or arcing from the junction between the connector contact and the center electrode terminal to the grounded outer shell or sleeve on the igniter.

In the prior art, it is known to provide a resilient rubber grommet or seal between the cable connector and the end of the igniter insulator. Often a spring is arranged to urge the seal against the insulator end to maintain a tight seal. The function of the seal is to prevent dirt and moisture from entering an annular space between the insulator on the end of the connector and the tubular igniter insulator end. However, sufficient dirt and/or moisture have sometimes passed the prior art seal and entered the annular space between the igniter and connector insulators to cause flashover.

DISCLOSURE OF INVENTION

According to the invention, an igniter cable connector is provided with an improved seal between an igniter insulator and a cable connector insulator to reduce the possibility of moisture or dirt from entering the space between the insulators and, accordingly, to reduce the risk of igniter failure due to flashover. The improved seal is effective to maintain ground level atmospheric pressure in the chamber between the igniter and the cable connector during high altitude operation in an aircraft engine.

The igniter has a high voltage terminal which is recessed in an open tubular end portion of an insulator. The insulator end portion is surrounded by a metal sleeve, which is either attached to or integral with an igniter shell. The sleeve extends in an axial direction past an open insulator end surface and has an exterior thread for securing the high voltage connector to the igniter. When the connector is secured to the igniter, an end of an insulator in the connector projects into the igniter insulator end and a high voltage contact located on a free end of the connector insulator engages the high voltage igniter terminal.

According to one embodiment of the invention, the connector insulator has a conical shoulder which faces outwardly and away from the free end of the insulator. A seal is located on the connector insulator to abut the shoulder. When the connector is secured to an igniter, a compression spring presses an annular spring retainer or cap against the seal to cause the seal to engage the connector insulator shoulder. This in turn causes the resilient seal to bulge or expand outwardly to press radially against the interior wall of the igniter insulator. At the same time, the spring and cap press the seal against the end of the igniter insulator. The portion of the resilient seal between the cap and the end of the igniter insulator expands in a radial direction to seal against the metal shell or sleeve on the igniter and against the connector insulator. The spring force and the resiliency of the seal produce fluid tight seals between the igniter and connector insulators and between the igniter shell, the connector insulator and the igniter insulator end. To enhance the seal, the spring cap has either a conical or a rounded surface portion and a flat radial surface portion which face towards the conical connector insulator shoulder.

According to another embodiment of the invention, the seal is retained in an annular groove around the connector insulator. The seal has a relatively thin annular lip located between the connector and igniter insulators. When the connector is secured to the igniter, the spring cap presses the seal lip against a shoulder defined by the end of the retaining insulator groove to cause the seal to bulge or expand into radial compression between the connector and igniter insulators. At the same time, the spring cap presses the seal against the end of the igniter insulator to cause the seal to bulge or expand into radial compression between the connector insulator and the igniter shell. Thus, multiple seals are formed between the connector insulator and the igniter. The designs of the insulator shoulder, the seal and the spring cap provide an effective seal for reducing the possibility of moisture or dirt entering the annular space between the igniter and connector insulators. Consequently, the risk of flashover or failure at the connector is reduced.

Accordingly, it is an object of the invention to provide an improved igniter cable connector seal.

Other objects and advantages of the invention will be apparent from the following detailed description and the accompanying drawings.

BEST MODE FOR CARRYING OUT THE INVENTION

Figure 1:
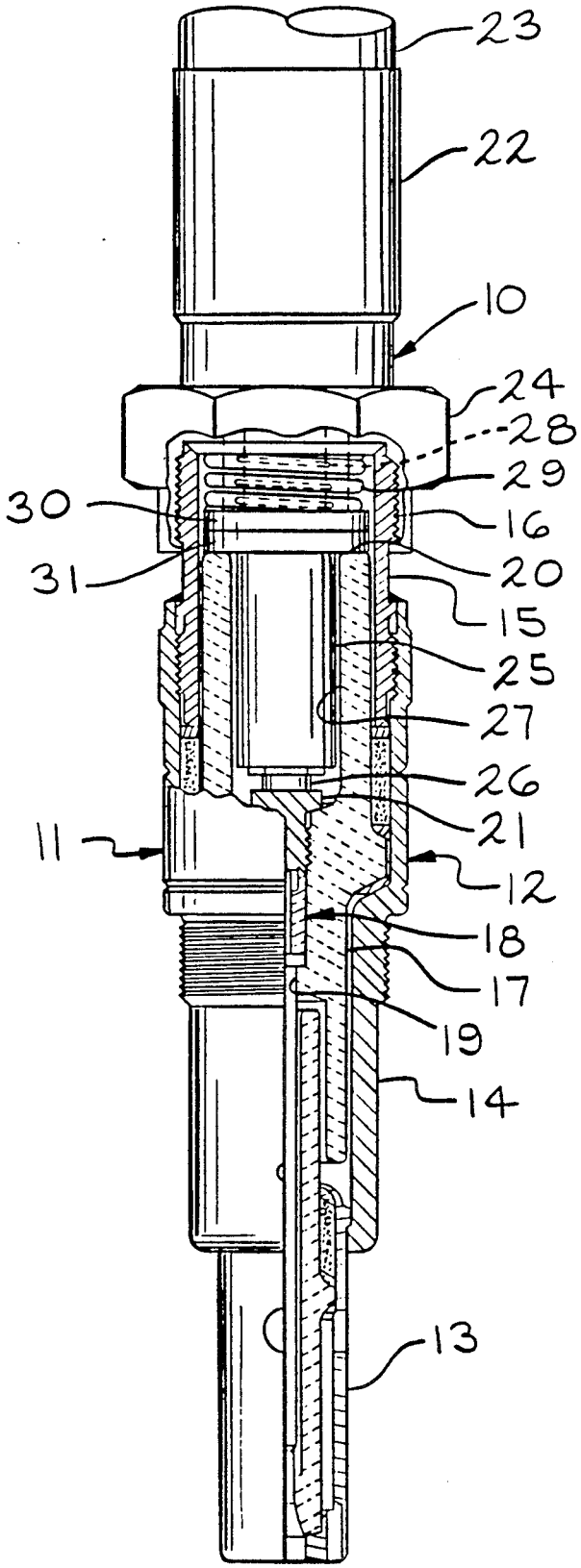
FIG. 1 (PRIOR ART)
FIG. 1 is a vertical view in partial section showing a high voltage ignition cable connector attached to an igniter according to the prior art.

Turning to FIG. 1 of the drawings, a prior art high voltage ignition cable connector 10 is shown attached to a conventional aviation engine igniter 11. The igniter 11 has a tubular shell 12 which may be formed from one or several sections. In the illustrated igniter 11, the shell 12 has a lower section 13, an intermediate section 14 and an upper section 15. The upper section 15 is in the form of a tubular sleeve and has an externally threaded end 16. A tubular insulator 17 is mounted in and shielded by the shell 12. A center electrode assembly 18 is mounted in a stepped axial bore 19 through the insulator 17. The insulator 17 has a free end 20 adjacent the threaded shell end 15. The center electrode 18 terminates at a terminal 21 recessed in the insulator bore 19 from the free end 20.

The connector 10 has a ferrule 22 which is clamped onto the exterior of a shielded high voltage ignition cable 23. A coupling nut 24 retained on the ferrule 22 engages the threaded igniter shell end 16 to attach the connector 10 to the igniter 11. The connector 10 has a tubular insulator 25 which projects through the coupling nut 24 and terminates at a contact 26. The contact 26 is electrically connected to a high voltage conductor (not shown) inside of the ignition cable 23. The insulator 25 insulates the contact 26 from electrically grounded components including the connector ferrule 22, the cable shielding and the coupling nut 24. The connector insulator 25 is sized to slide into an end section 27 of the igniter insulator bore 19 above the terminal 21.

When the connector 10 is attached to the igniter 11, the connector contact 26 contacts the igniter terminal 21. A first or inner spring 28 in the connector 10 urges the insulator 25 and the contact 26 into the igniter bore end section 27 to urge the contact 26 against the terminal 21 for maintaining a high voltage electrical connection at all times. The connector also includes a second or outer spring 29, a tubular spring retainer or cap 30 and a resilient annular seal 31. When the connector 10 is attached to the igniter 11, the spring 29 presses in an axial direction on the spring retainer 30 to compress the seal 31 against the igniter insulator end 20. As a consequence of the force of the spring 29 and the resiliency of the seal 31, a continuous annular seal is formed between the spring retainer 30 and the igniter insulator end 20 and the connector insulator 25. The purpose of the seal is to keep dirt, moisture and other contaminants from the annular region between the igniter insulator bore end section 27 and the connector insulator 25. However, under certain operating conditions, sufficient contaminants may enter this region to cause arcing from the high voltage terminal 21 and/or the contact 26 and the upper shell section 15.

Figure 2:
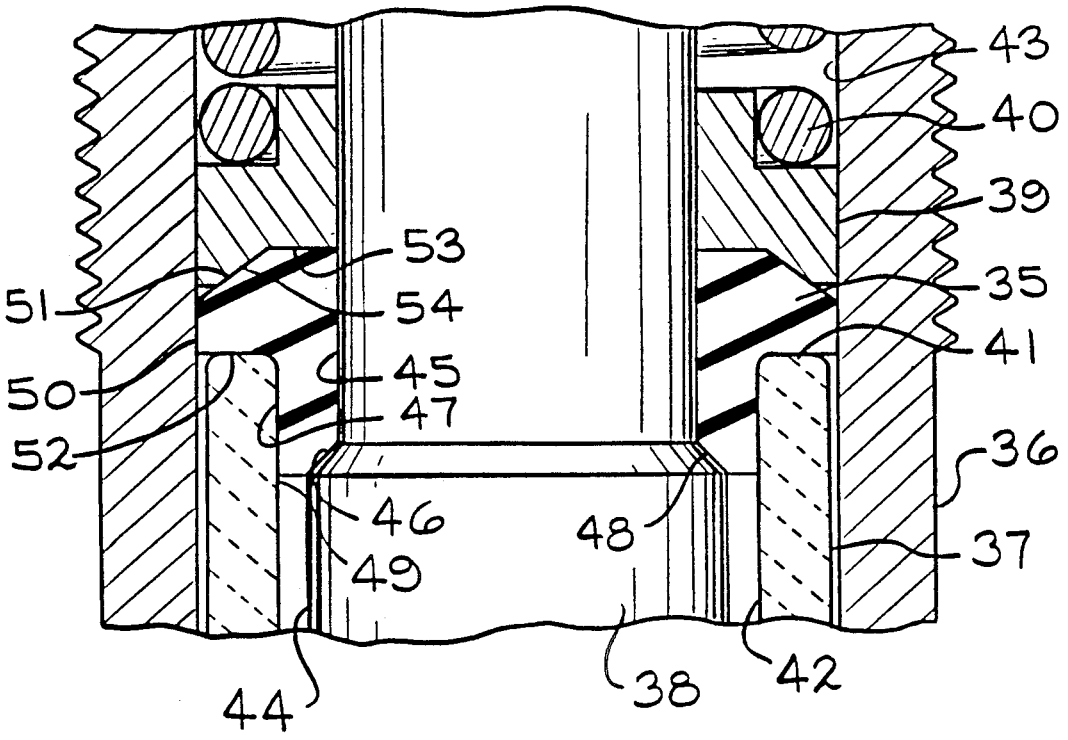
FIG. 2 is an enlarged fragmentary vertical view in partial section showing a seal between a high voltage ignition cable connector and an igniter according to a first embodiment of the invention.

FIG. 2 is an enlarged fragmentary view, in partial section, of an improved seal 35 according to one embodiment of the invention located between an igniter shell 36, an igniter insulator 37, a connector insulator 38 and a retainer or cap 39 for a connector spring 40. The igniter insulator 37 has an end 41 and a cylindrical opening 42 in which a high voltage terminal (not shown) is recessed. The shell 36 has a cylindrical interior wall 43 which surrounds the igniter insulator 37 and extends past the insulator end 41. The exterior surface of the connector insulator 38 is stepped with an end portion 44 located toward the igniter having a diameter sized to pass into the igniter insulator opening 42, a smaller diameter portion 45 and a conical shoulder 46 extending between the insulator portions 44 and 45. The shoulder 46 faces generally toward the spring retainer 39.

The seal 35 has a first portion 47 which terminates at an end 48 which abuts the shoulder 46. The first portion 47 has a wall thickness which permits the first portion 47 to pass into an annular space 49 formed between the connector insulator 38 and the igniter insulator 37 when the connector is secured to the igniter. The seal 35 has a second portion 50 having an end surface 51 which contacts the spring retainer 39 and, when the connector is secured to the igniter, a surface 52 which contacts the igniter insulator end 41. The spring retainer 39 contacts the seal 35 with a flat surface portion 53 and a conical surface portion 54 which surrounds the flat surface portion 53. The conical surface portion 54 is generally directed inwardly and toward the insulator shoulder 46.

When the connector is secured to the igniter, the spring 40 is compressed and the spring retainer 39 exerts sufficient force on the resilient seal 35 to compress the seal 35 against the connector insulator shoulder 46 and the igniter insulator end 41. Sufficient force is exerted on the connector insulator shoulder 46 to cause the first seal portion 47 to bulge or expand in a radial direction, forming a seal between the igniter insulator 37 and the connector insulator 38. At the same time, sufficient force is exerted on the insulator end 41 to cause the second seal portion 50 to bulge or expand in a radial direction, forming a seal between the igniter insulator end 41, the adjacent shell wall 43 and the connector insulator 38. Thus, two distinct seal areas are formed between the igniter and the connector to prevent moisture and dirt from entering the annular space 49 formed between the insulators 37 and 38.

Figure 3:
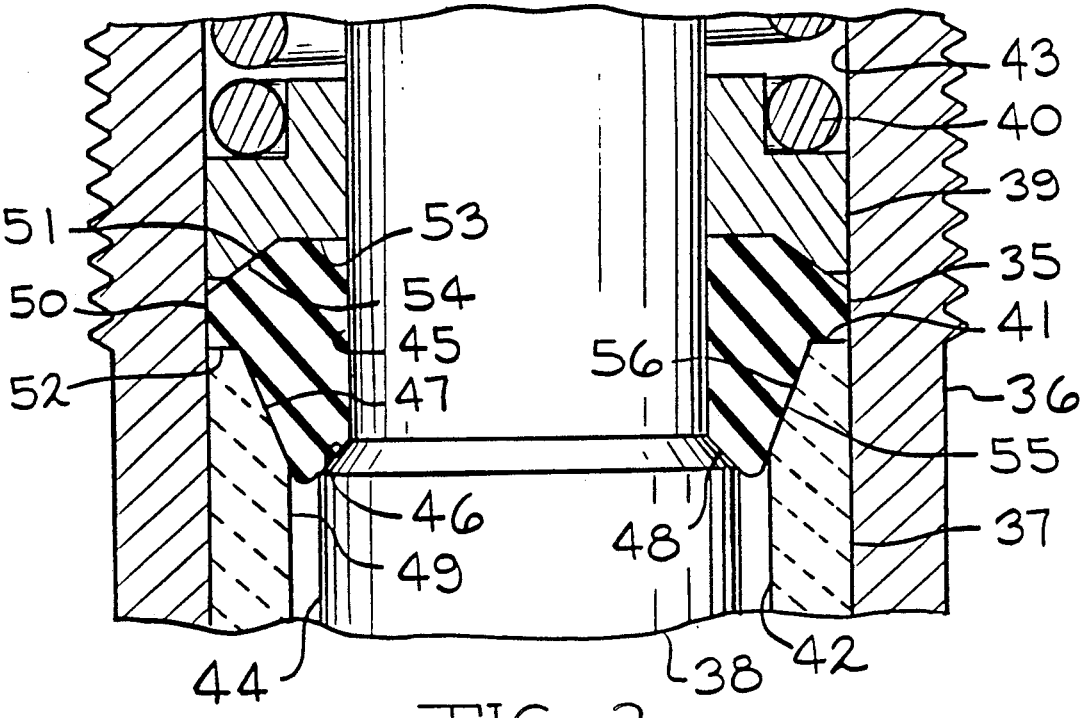
FIG. 3 is an enlarged fragmentary vertical view in partial section showing a seal between a high voltage ignition cable connector and an igniter according to a second embodiment of the invention.

FIG. 3 shows a modification of the seal 35 from FIG. 2. Similar parts shown in FIGS. 2 and 3 are labeled with the same reference numbers. The difference between the seal 35 of FIG. 2 and a modified seal 35' of FIG. 3 is that the first seal portion 47 has a conical surface 55 which abuts a conical surface portion 56 on the igniter insulator 37 adjacent the end 41. The conical surfaces 46 and 56 provide an annular wedge shape to the opening 49 about the axis of the igniter. The force exerted by the spring 40 and the spring retainer 39 on the seal 35' causes the first portion 47 of the seal 35' to wedge tightly between the igniter insulator 37 and the connector insulator 38. The second seal portion 50 is still compressed between the spring retainer 39 and the igniter insulator end 41 and expands to form a second seal area between the igniter insulator end 41, the interior shell wall 43 and the connector insulator 38.

Figure 4:
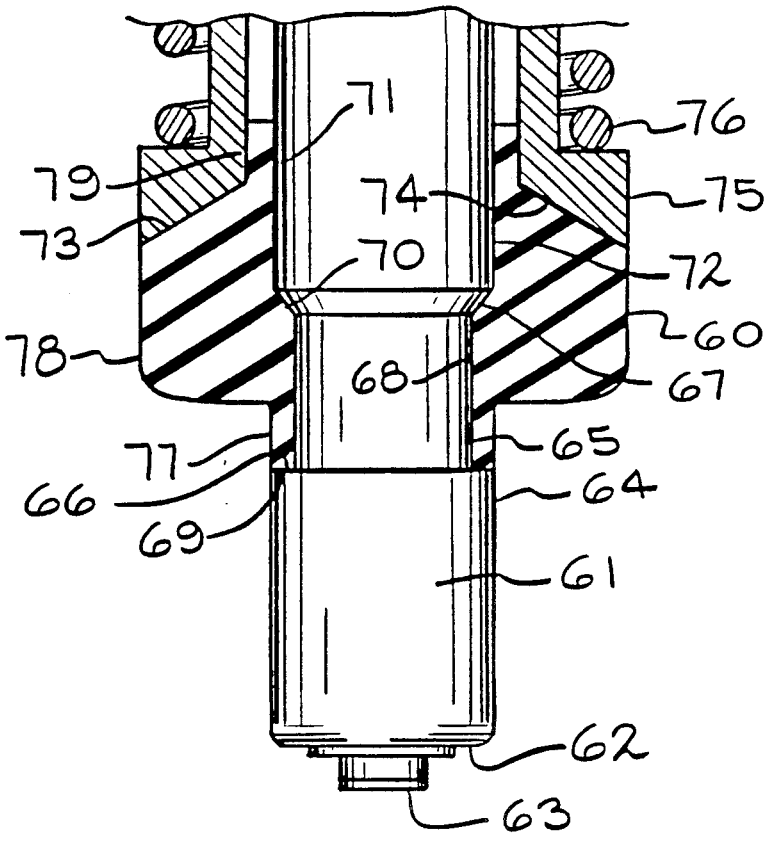
FIG. 4 is an enlarged vertical view in partial section showing a fragmentary portion of a high voltage ignition cable connector according to a third embodiment of the invention.
Figure 5:
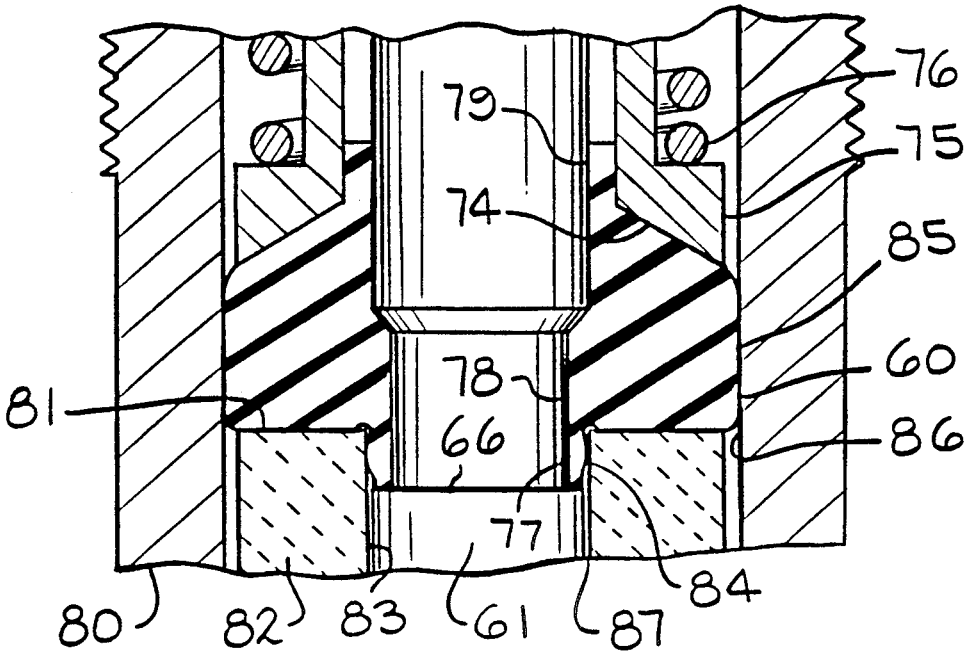
FIG. 5 is an enlarged fragmentary vertical view in partial section showing a seal between a high voltage ignition cable connector and an igniter according to the third embodiment of the invention.

FIGS. 4 and 5 show a further embodiment of an igniter connector seal 60 according to the invention. The connector, which is only partially shown, has an insulator 61 having an end 62 which supports a high voltage contact 63. The insulator 61 has a cylindrical exterior surface 64 in which an annular groove 65 is formed. The groove 65 has a smaller diameter than the diameter of the surface 64 and has a flat end 66 towards the insulator end 62 and a conical end 67 spaced further from the insulator end 62. The groove end 66 defines a shoulder on the insulator 61. The seal 60 is annular and extends around the connector insulator 61. The seal 60 has an interior surface area 68 which engages the groove 65, an end 69 which abuts the groove end 66, a surface area 70 which abuts the conical groove end 67 and a surface area 71 which engages a surface 72 of the insulator adjacent the conical end 67. The seal 60 further has a surface 73 which abuts a conical surface 74 on a retainer or cap 75 for a spring 76. The seal 60 has a first portion 77 adjacent the groove end 66 which normally has substantially the same exterior diameter as the connector insulator 61, a second portion 78 having a larger diameter and a third portion 79 which is located coaxially within the spring retainer 75. The third seal portion 79 centers the spring retainer 75 coaxially on the seal 60.

FIG. 5 shows a portion of the connector positioned within the shell 80 of an igniter. The seal 60 is shown as it is deformed when the connector is secured to the igniter. An end 81 of an insulator 82 is located within the shell 80. The first seal portion 77 extends into a bore 83 in the insulator 82. When the connector is secured to the igniter, the conical surface 74 on the spring retainer 75 compresses the resilient seal 60 downwardly and inwardly against the igniter insulator end 81 and against the connector insulator groove end 66. When the seal 60 is compressed in an axial direction, it expands or bulges in a radial direction. Compressing the first seal portion 77 against the shoulder formed by the groove end 66 causes it to expand or bulge in a radial direction at 84 to form an annular seal between the connector insulator 61 and the igniter insulator 82. Compressing the second seal portion 78 against the igniter insulator end 81 causes it to expand or bulge both inwardly and outwardly in a radial direction at 85 to form an annular seal between the igniter insulator 61, an interior wall 86 of the shell 80, and the igniter insulator end 81. Thus, multiple seal areas are formed by the seal 60 between the igniter and the connector to reduce the risk of moisture, dirt and other contaminant from entering an annular space 87 between the bore 83 in the igniter insulator 82 and the connector insulator 61. Accordingly, the risk of a failure of the igniter caused by arcing between the igniter and the connector is reduced.

It should be noted that the seal of the invention need not seal against the igniter shell to effectively form multiple seal areas between the igniter and connector insulators. However, when the seal is deformed sufficiently to press against the igniter shell, the inwardly directed force between the seal and the connector insulator is increased. It will be appreciated that various modifications and changes may be made in the above described preferred embodiments of a seal for an igniter cable connector without departing from the spirit and the scope of the following claims.

What is claimed is:

1. In a high voltage cable connector for engaging an igniter having an insulator, a terminal recessed in a cylindrical opening in an end of said igniter insulator, a metal shell supporting and shielding said igniter insulator, said shell having an exterior threaded portion, said connector having an insulator with an end for passing into said igniter insulator opening, a high voltage contact supported on said end of said connector insulator for electrically engaging said igniter terminal, a compression spring and a spring retainer positioned coaxially over said connector insulator, and a coupling nut having an internally threaded portion for engaging said threaded shell portion to secure said connector to said igniter, an improved seal assembly between said connector and said igniter comprising an annular shoulder formed on said connector insulator end to generally face said spring retainer, and a resilient annular seal positioned on said connector insulator to abut said spring retainer, said seal having a first portion located between said shoulder and said spring retainer and a second portion located between the igniter insulator end and said spring retainer when said connector is secured to the igniter, said first seal portion extending into an annular space between said connector insulator and the igniter insulator, said spring and said spring retainer compressing said first seal portion against said shoulder with sufficient force to expand said first seal portion in a radial direction to form a first seal area extending radially between said connector insulator and the igniter insulator when said connector is secured to an igniter, said spring and said spring retainer compressing said second seal portion in an axial direction against said igniter insulator end and inwardly against said connector insulator to form a second seal area between the igniter insulator end and said connector insulator when said connector is secured to an igniter.

2. An improved seal assembly between a cable connector and an igniter, as set forth in claim 1, wherein said second seal portion expands sufficiently in a radial direction to seal against the igniter shell when said connector is secured to an igniter.

3. An improved seal assembly between a cable connector and an igniter, as set forth in claim 1, wherein said spring retainer has a conical surface portion engaging said seal, said conical surface portion pressing said seal inwardly towards said connector insulator shoulder when said connector is secured to an igniter.

4. An improved seal assembly between a cable connector and an igniter, as set forth in claim 3, wherein said connector insulator shoulder is conical and is directed towards said conical spring retainer surface portion.

5. An improved seal assembly between a cable connector and an igniter, as set forth in claim 4, wherein said connector is secured to an igniter having a conical surface engaging said seal adjacent said insulator end, said conical insulator surface and said conical shoulder defining a wedge shaped annular groove receiving said first seal portion.

6. In a high voltage cable connector for engaging an igniter having an insulator, a terminal recessed in a cylindrical opening in an end of said igniter insulator, a metal shell supporting and shielding said igniter insulator, said shell having an exterior threaded portion, said connector having an insulator with an end for passing into said igniter insulator opening, a high voltage contact supported on said end of said connector insulator for electrically engaging said igniter terminal, a compression spring and a spring retainer positioned coaxially over said connector insulator, and a coupling nut having an internally threaded portion for engaging said threaded shell portion to secure said connector to said igniter, an improved seal assembly between said connector and said igniter comprising an annular groove formed about said connector insulator, said groove having a first end forming an annular shoulder formed on said connector insulator end to generally face said spring retainer, and a resilient annular seal positioned on said connector insulator to abut said spring retainer, said seal having an interior surface engaging said groove and having a first portion located between said shoulder and said spring retainer and a second portion located between the igniter insulator end and said spring retainer when said connector is secured to the igniter, said first seal portion extending into an annular space between said connector insulator and the igniter insulator and said spring compressing said first seal portion against said shoulder to expand said first seal portion in a radial direction to form a first seal area between said connector insulator and the igniter insulator when said connector is secured to an igniter, said spring compressing said second seal portion against said igniter insulator end to expand said second seal portion in a radial direction to form a second seal area between the igniter insulator end and said connector insulator when said connector is secured to an igniter.

7. An improved seal assembly between a cable connector and an igniter, as set forth in claim 6, wherein said groove has a conical second end facing the igniter insulator end when said connector is secured to an igniter.

8. An improved seal assembly between a cable connector and an igniter, as set forth in claim 7, wherein said seal has a third portion extending coaxially within said spring retainer, said third seal portion aligning said spring retainer coaxially with said second seal portion.

9. An improved seal assembly between a cable connector and an igniter, as set forth in claim 8, wherein said second seal portion expands sufficiently in a radial direction to seal against the igniter shell when said connector is secured to an igniter.

10. An improved seal assembly between a cable connector and an igniter, as set forth in claim 1, wherein said seal has a third portion extending coaxially within said spring retainer, said third seal portion aligning said spring retainer coaxially with said second seal portion.

11. In a high voltage cable connector for engaging an igniter having an insulator, a terminal recessed in a cylindrical opening in an end of said igniter insulator, a metal shell supporting and shielding said igniter insulator, said shell having an exterior threaded portion, said connector having an insulator with an end for passing into said igniter insulator opening, a high voltage contact supported on said end of said connector insulator for electrically engaging said igniter terminal, compression spring means positioned coaxially over said connector insulator, and a coupling nut having an internally threaded portion for engaging said threaded shell portion to secure said connector to said igniter, an improved seal assembly between said connector and said igniter comprising an annular shoulder formed on said connector insulator end to generally face said spring means, and a resilient annular seal positioned on said connector insulator to abut said spring means, said seal extending between said connector insulator shoulder and said spring means, said seal extending into an annular space between said connector insulator and the igniter insulator and said spring means compressing said seal against said shoulder with sufficient force to expand said seal in a radial direction to form a seal area extending radially between said connector insulator and the igniter insulator when said connector is secured to an igniter.

12. An improved seal assembly between a cable connector and an igniter, as set forth in claim 11, wherein said connector insulator has an annular groove having an end facing said spring means, and wherein said groove end forms said connector insulator shoulder.

* * * * *